US005630392A

United States Patent [19]

Harris

[11] Patent Number: 5,630,392

[45] Date of Patent: May 20, 1997

[54] EXHAUST BRAKE

[75] Inventor: Victor A. Harris, Nr. Arundel, United Kingdom

[73] Assignee: Hersham Valves Limited, Ford, United Kingdom

[21] Appl. No.: 564,136

[22] PCT Filed: Jun. 16, 1994

[86] PCT No.: PCT/GB94/01300

§ 371 Date: Dec. 14, 1995

§ 102(e) Date: Dec. 14, 1995

[87] PCT Pub. No.: WO94/29583

PCT Pub. Date: Dec. 22, 1994

[30] Foreign Application Priority Data

Jun. 16, 1993 [GB] United Kingdom ..... 061693

[51] Int. Cl.[6] ..... F02D 9/06

[52] U.S. Cl. ..... 123/323

[58] Field of Search ..... 123/323; 188/273; 251/63.6, 25; 137/630.12, 513.3

[56] References Cited

U.S. PATENT DOCUMENTS

| | | | |
|---|---|---|---|
| 4,819,696 | 4/1989 | Takikawa et al. | 137/630.12 |
| 4,840,348 | 6/1989 | Takigawa et al. | 251/63.6 |
| 4,886,148 | 12/1989 | Suzuki | 188/273 |
| 4,901,827 | 2/1990 | Suzuki | 188/273 |
| 4,903,733 | 2/1990 | Suzuki | 137/630.12 |
| 4,923,167 | 5/1990 | Schmidt | 251/25 |
| 5,086,738 | 2/1992 | Kubis et al. | 123/323 |
| 5,103,786 | 4/1992 | Suzuki et al. | 123/323 |
| 5,394,901 | 3/1995 | Thompson et al. | 137/513.3 |

*Primary Examiner*—Raymond A. Nelli
*Attorney, Agent, or Firm*—Ladas & Parry

[57] ABSTRACT

According to the present invention there is provided an exhaust brake of the sliding valve gate type comprising a piston cylinder device for operating the slidable valve gate to open or close the exhaust brake, an aperture through the valve gate for relieving manifold pressure, and control means for controlling the passage of exhaust gases through the aperture in the valve gate, wherein the control means is variably selectable to control venting of exhaust gases according to driving conditions of a vehicle as determined by the driver of the vehicle.

14 Claims, 3 Drawing Sheets

EXHAUST BRAKE

This invention relates to an exhaust brake particularly of the type which is generally referred to as sliding gate type exhaust brake.

Exhaust brakes are devices which obstruct the outflow of exhaust gases of an engine and builds up a back pressure in the exhaust manifold of the engine as far back as the engine pistons. On the travel of the piston to its top dead centre position the piston will act against this pressure and this has a marked retardation effect on a vehicle which is driven by its forward momentum only and acts as a non-fade supplementary braking system.

Such devices are well known and have been in use for many years. A large number of such devices incorporate a fixed orifice through the slidable gate or closure plate to comply with engine manufacturers criteria, that the exhaust manifold pressure will not exceed a given pressure at engine overspeed, in some cases plus ten percent of rated engine speed. The main reason for this is to limit exhaust valve lift.

An exhaust brake which builds excessive pressure in the manifold system will cause the exhaust valve to lift from its seat, this pressure then drops rapidly when passing into the cylinder bore or, on valve overlap through to the atmosphere via the air intake, and the exhaust valve then returns to its seat at high speed. This is known as the "Hammer Effect" and has a long term detrimental effect on both valve and seating.

JP-A-58 158333 discloses a variable aperture control dependent upon engine revolutions and has improved the previously known defects on the valve and seating. The engine revolutions are however monitored separately electrically and the signal representing the number of revolutions processed to control the amount of opening of a rotary bar valve to variably vent exhaust gases past the exhaust gate valve.

Recent innovations such as that disclosed in our co-pending European Patent 0.205.310 have improved the performance of exhaust brakes, notably those which have the ability to control manifold pressure without fixed orifices, these devices use a manifold pressure to open an orifice in the face of the closure member and bleed excessive pressure therethrough into the exhaust system. This pressure is sensed by a closure plate of a known size which is balanced against a remotely mounted spring of known rate and thus the manifold pressure is used to open and the spring to close the orifice.

Like most retarding devices exhaust brakes act on the drive axle of the vehicle and with the enhanced performance of these devices, up to four hundred brake horse power has been recorded. Great care must be taken therefore when applying the exhaust brake especially when the vehicle is empty or on wet greasy roads, in these conditions an articulated vehicle could be prone to jackknife blocking the road to oncoming traffic.

With all known exhaust brakes in use at the present time, both the fixed orifice and the spring balanced brake types, the exhaust brake is operated to be either on or off. Therefore, the driver in adverse conditions has only two choices. Either he applied his exhaust brake and risks the "jackknife" or deprives himself of the use of the exhaust brake.

Some attempts have been made to allow the driver of a vehicle to vary the amount of retardation obtained from the exhaust brake. The most successful of these comprises a switch under control of the driver acting on the operation of a cylinder mechanism which allows the exhaust brake to partially close. However, this method is erratic because the force generated by the operating cylinder is counteracted by the manifold pressure acting on the closure member because the manifold pressure is a sum of the size of the opening through the exhaust brake valve and the amount of air produced by the engine. It follows therefore that engine revolutions control the position of the closure valve. It is also a fact that from the position first selected, the manifold pressure cannot be lowered unless the exhaust brake is first deactivated because once the operating cylinder closure member equilibrium is altered the main spring of the operating cylinder will return the exhaust brake to the open position.

It is an object of the present invention to produce an exhaust brake which has the maximum retardation but is controllable by the driver to increase or decrease manifold pressure/retardation as required.

According to the present invention there is provided an exhaust brake of the sliding valve gate type comprising a piston cylinder device for operating the slidable valve gate to open or close the exhaust brake, an aperture through the valve gate for relieving manifold pressure, and control means for controlling the passage of exhaust gases through the aperture in the valve gate, wherein the control means is variably selectable to control venting of exhaust gases according to driving conditions of a vehicle as determined by the driver of the vehicle.

In one preferred embodiment of the present invention there is provided adjustment means locatable in the driving compartment of a vehicle for controlling the pressure level of fluid applied to the exhaust brake. The adjustable means being additional to the usual exhaust brake valve operating mechanism.

In an alternative embodiment in accordance with the present invention the exhaust brake comprises a seal housing assembly located in a piston cylinder assembly of the exhaust brake, the seal housing assembly having first and second seal housing operable from the same fluid pressure source. Conveniently, the second seal housing is located within a cylinder attached to the first seal housing. Preferably, the cylinder is attached to that side of the first seal housing remote from the pressure fluid input thereto. The first seal housing may have passage means for allowing the pressurised fluid to be applied to the second seal housing.

In a further embodiment of the present invention the second seal housing is attached to a shaft rod at one end thereof, the opposite end of the shaft rod being connected to a valve plate for controlling the exhaust or venting aperture through the sliding gate of the exhaust brake. Conveniently, the second seal housing can abut against the shaft rod rather than be permanently attached thereto.

The shaft rod is movable relative to the valve gate and extends through a hollow push rod fixed to the valve gate but being free at its opposite end. Conveniently, the free end of the hollow push rod is spaced 6 mm from the first seal housing cylinder in the open condition of the exhaust brake to assist the main spring to withdraw the gate on high manifold pressure engines, but can be attached directly to the first seal housing.

In yet another preferred embodiment of the present invention the exhaust gas venting aperture is controlled by applying operating air pressure to a first piston and increased operating air pressure to a second piston once the usual operating air pressure acting upon the main piston has moved the sliding gate to the closed position.

Conveniently, the adjustable pressure level is above that pressure usually required to close the exhaust brake valve.

Preferably, the change in pressure is in steps of 103.42 kPa (15 lbs. sq. in.) but would be variable up to the maximum of pressure stored by the vehicles air reservoir.

An embodiment of the present invention will now be described by way of example with reference to the accompanying drawings, in which:

FIGS. 1, 2 and 3 show an exhaust brake which is arranged for fitment in an exhaust manifold pipe system of circular cross-section.

Figure 1:
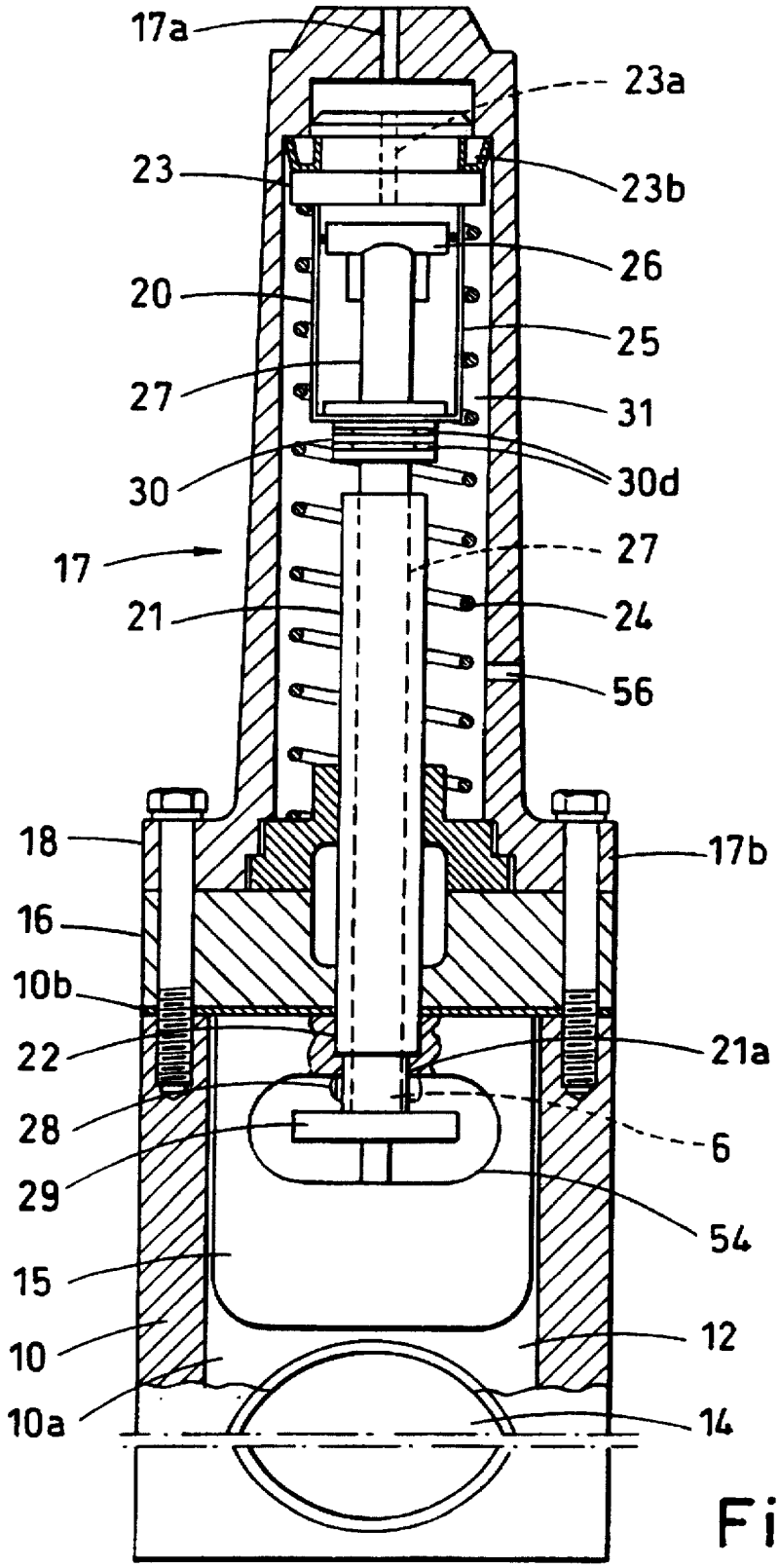
FIG. 1 is a part sectional front elevational view of an exhaust brake according to the present invention.

The exhaust brake comprises a hollow body 10 having opposed walls 11 and 12 which define a valve chamber 10*a* therebetween and apertures 13 and 14 in the walls 11 and 12, respectively, which apertures define an exhaust passage through the chamber. A valve closure gate 15 is slidably mounted in the housing with a loose sliding fit in the valve chamber and is capable of sealing engagement with an inner surface of either of the walls 11 and 12. The gate is movable between the position shown in FIG. 1 in which the gate is clear of the apertures 13 and 14 to leave the exhaust passage substantially unobstructed, and a position in which the gate closes the apertures 13 and 14 to close the exhaust passage.

The walls 11 and 12 are adapted to be fitted, by their outside surfaces, to suitable flange joints in the exhaust system although such connections are omitted for the sake of clarity.

The valve chamber of the hollow body 10 opens to an end face 10*b* of the body which is closed by a removable back plate 16 which also forms an end stop for the movement of the valve gate 15 to the open position of the exhaust brake. A single acting fluid pressure operated piston and cylinder device, indicated generally at 17, is mounted by a flange 17*b* on the body 10 outside the back plate 16. Bolts 18 and 19 are screw threaded into the body 10 and serve to clamp the plate 16 between the device 17 and the body 10.

The fluid pressure device 17 comprises a seal housing assembly 20 and a hollow elongate push rod 21 which extends through the plate 16 into a bore 22 in the valve gate 15. The push rod 21 has a reduced diameter portion 21*a* at its end adjacent the valve gate to firmly locate the rod in the valve gate 15 by a friction fit. The opposite end of push rod 21 is spaced for example by 6 mm, from seal housing assembly 20 which comprises a main seal housing or piston 23 biased by main spring 24 towards the end of the piston cylinder assembly remote from the valve gate 15.

The seal housing assembly 20 further includes on the valve gate side of the main piston 23 a cylindrical chamber 25 in which is slidably located a secondary seal housing or actuator piston 26. The piston 26 is attached to an elongate shaft rod 27 which extends through the hollow piston push rod 21. The shaft rod 27 is coupled to valve gate 15 via a crosspin 28 and abuts to pressure plate 29 for controlling the venting of exhaust gases through the valve gate 15 as described below.

The piston assembly 20 has an aperture in the side thereof remote from piston 23 through which the shaft rod 27 heat resisting material extends. A seal housing 30 is located on the assembly 20 over the shaft rod aperture to seal the assembly 20 from leaks of the pressurised fluid from the assembly. Seals 30*a* are provided to maintain the seal with push rod 21. In FIG. 1 it is the bottom of seal housing 30 which is spaced by 6 mm from the end of hollow rod 21 in the open condition of the exhaust valve. If not required the gap can be closed by increasing the push rod 21 length by 6 mm.

Figure 2:
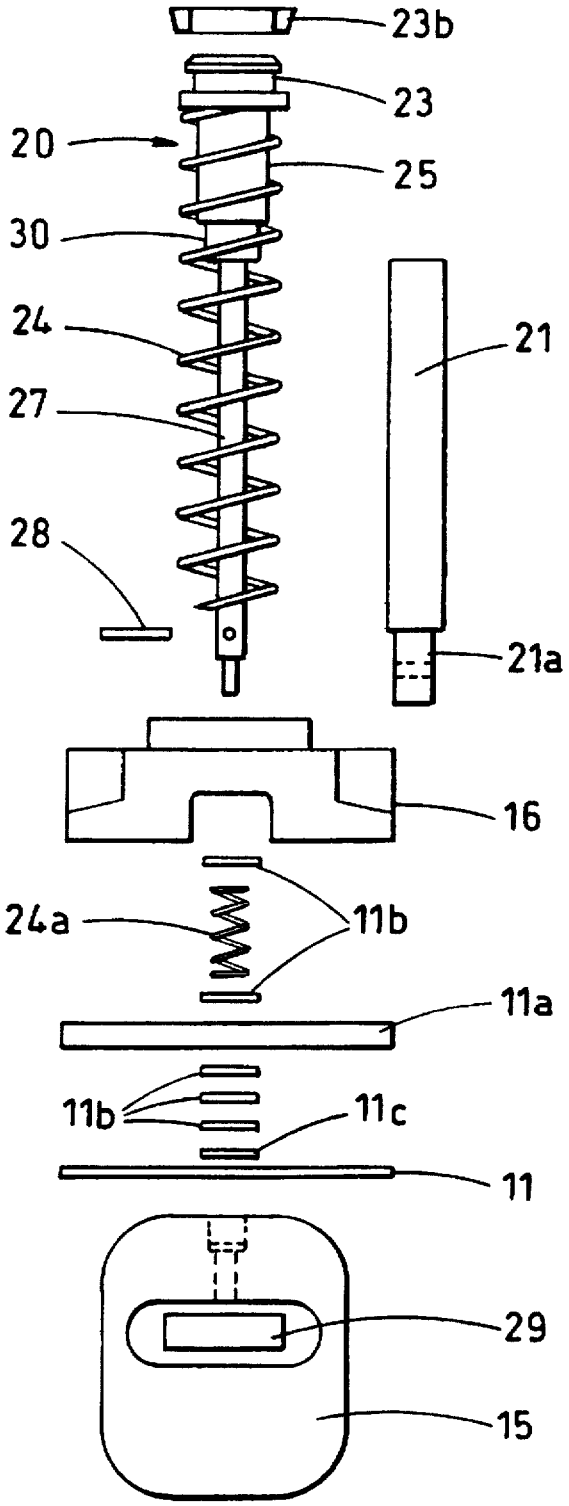
FIG. 2 is an exploded view of the preset valve gate, end plate and internal operating piston assembly of the exhaust brake of FIG. 1.

The main seal housing or piston 23 sealingly engages the inner surfaces of the fluid pressure device 17 and the seal housing or piston 26 is sealingly engaged with the inner cylindrical surface of the chamber 25 by conventional seal rings between each piston and its respective cylindrical surface. An aperture 17*a* extends through the end of the device 17 remote from the valve gate for introducing fluid into the device under pressure to move the piston 23. This piston in turn has a passageway 23*a* therethrough to allow some fluid therethrough for acting upon the piston 26 to move the same as later described in detail. As shown in FIG. 2 the seal housing assembly has a rubberised or synthetic seal 23*b* for sealing the housing 23 against the internal cylindrical surface of the piston cylinder device 17.

Moreover, the valve gate body 10 is connected to the piston cylinder device 17 by bolts 18, 19 and has sandwiched between these two parts a gasket 11, a backplate 11*a* and end plate 16. Washers 11*b*, red washers, are located between each of the gasket and backplate, or back plate and end plate. Only two washers are located between these latter two parts and these washers are separated by a spring 24*a* which stops the washers chattering and ensures pressure is applied to the washers to force them against the rod 21 to scrape the same clean from carbon deposits. The remaining washers 11*b* with a steel washer 11*c* also act as scraper washers.

Figure 4:
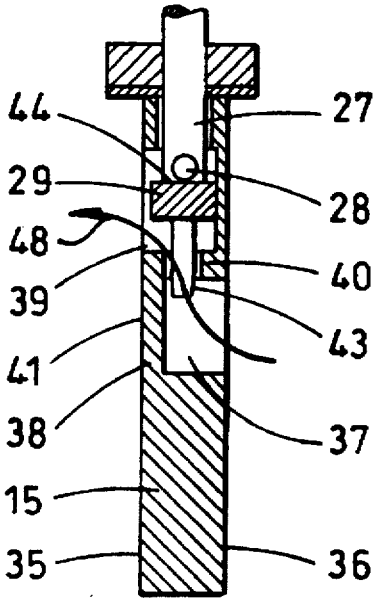
FIG. 4 is a cross-sectional view of a valve gate of the known control mechanism for opening and closing an aperture through the valve gate of FIGS. 1, 2 or 3.

The valve gate 15 more clearly shown in FIGS. 4 is provided with opposed planar surfaces 35, 36. A recess 37 is provided in gate surface 36, which extends into the body of the valve gate 15 leaving a relatively thin wall portion 38 separating the recess 37 from the opposite side 35 of the valve gate. A further recess 39 is provided in opposite gate surface 35 adjacent to recess 37, and being separated by a common side wall 40. One recess communicates with the other by an elongate aperture 41 through the common recess wall 40.

In FIG. 4, pressure plate 29 is located in the recess 39 and is engageable with wall 40 to completely close the aperture 41 therethrough. The plate 29 is mounted at the valve gate end of shaft rod 27 for sliding movement within the recess 39 to allow opening and closing of the aperture 41. The plate 29 is loosely connected with the shaft rod 21 for movement in both axial and transverse directions relative to the longitudinal axis of the piston rod to ensure free movement of the plate 29 relative to the shaft rod under high temperature and carbon coated conditions. More particularly the end of the shaft rod 27 on which the gate 15 is mounted, has an end portion 43 of reduced diameter which extends through a corresponding aperture in plate 29 and exhaust gas vent aperture 41. As shown in FIG. 4 the plate 29 abuts a shoulder 44 defined by the change in diameter between end portion 43 and the remainder of the piston rod. The shaft 44 serves to push the plate 29 towards aperture 41 upon movement of the shaft rod 27 to the left in FIG. 1.

The position of the plate 29 relative to the aperture 41 is dependent upon return spring 24 and piston 26 of the assembly 20. Spring 24 is the main spring which directly effects return movement of the gate 15 relative to the exhaust aperture 13, 14 of the body 10 as shown with reference to the exhaust brake of FIGS. 1 and 2. The spring 24 is located in the piston cylinder assembly is subject to a maximum temperature of 107° C., well below the setting temperature of the spring.

To operate the slidable gate assembly to close the exhaust passage of the exhaust brake, pneumatic pressure is applied to the top of the fluid pressure device 17 of FIG. 1 via passage 17*a*. As this pressure is applied, the main piston assembly 23 moves 6 mm until it engages free end of push rod 21 connected to the valve gate 15. In the open condition of the exhaust valve as shown in FIG. 1 the piston 26 is substantially adjacent the piston 23 and any movement of piston 23 causes engagement of piston 23 with piston 26 whereupon the pistons move together and then the assembly 20 engages push rod 21 via seal housing 30 push rod 21 by closing the 6 mm gap therebetween. Further pressure on the main piston assembly 23 causes the gate 15 to close the exhaust passage 14 through the exhaust valve. The initial movement of the main piston 23 also causes the piston rod 21 to move downwardly in the drawings initially forcing the plate 29 against the wall 40 and closing the aperture 41. The push rod 21 continues to move downwardly forcing the gate 15 across the exhaust gas passage. Additional pressure applied to the piston 23 which could not move further forward in the closed position of the exhaust brake by the stop effected by compression of spring 24 and the valve gate against a bottom stop in housing 10 is applied to piston 26 to close the aperture 41.

In this closed position of the exhaust valve exhaust gases from the exhaust manifold of an internal combustion engine build up pressure on the face of the gate 15 in which the recess 37 is provided and at an appropriate or preset pressure to the gases pass, as indicated by arrow 48 through the exhaust valve. The exhaust gas is applied to the plate 29 through the aperture 41 in the wall 40. When the pressure of the exhaust gas is sufficient in the plate 29 and shaft rod 27 are forced upwardly in the drawings by the exhaust gases to allow gas flow through aperture 41 in the valve gate 15. The shaft rod 27 moves to the right moving the piston 26 towards the piston 23.

As the plate 29 moves to open the aperture 41 the exhaust gases are vented through this aperture, as indicated by arrow 48, to the exhaust outlet pipe of the vehicle to which the exhaust brake is connected.

When the pressure of exhaust gases drops following venting through apertures 41 and recesses 37 and 39, the additional pneumatic pressure applied to piston 26 forces the shaft rod 27 and therefore the plate 29 towards the wall 40, again closing aperture 41 until the exhaust gas pressure in the engine manifold is sufficient to overcome the force of the additional pneumatic pressure to lift the plate 29 and vent the exhaust gases as before.

During this closed condition of the exhaust brake in which the flow rate of exhaust gases is high, the exhaust gases are substantially continuously applied to the face of the gate 15 and passes through aperture 41 to act against plate 29. A balance position is reached where the pressure of the exhaust gases equalises with the pressure exerted on piston 26 via the plate 29 spaced from the aperture 41. This spacing may vary slightly in accordance with engine revolutions as relative steady pressure is maintained.

Therefore, it can be seen that the manifold pressure is dependent upon the additional hydraulic/pnumatic pressure applied on the piston 26 which advantageously being located in the device 20 at the end of the piston rod 21 remote from the gate 15, is subject to temperatures which are well below the setting temperatures of the spring 24, even when the gate 15 is subjected to its highest operating temperature.

As previously described, when the piston 23 is to be moved air under pressure is fed into the assembly 17 through aperture 17*a*. Some of that air passes through aperture 23*a* in the piston 23 into the space between the piston 23 and piston 26. The effect of pressure upon the piston 26 is to force the shaft rod 27 in FIG. 1 to move plate 29 towards the wall 40 of the valve gate 15, thus restricting flow of exhaust gases from the exhaust manifold of engine to which the exhaust brake is attached. Because the cross sectional area of the piston 26 is much smaller than that of the piston 23 the piston 26 is more readily available for moving the shaft rod 27 in accordance with relatively minor changes in pressure of the pressurised air fed into the assembly 17.

By selecting various pressures the position of the piston 26 within the cylinder 25 can be adjusted accordingly and hence the relative position between the plate 29 and the aperture 41 can similarly be controlled.

Figure 5:
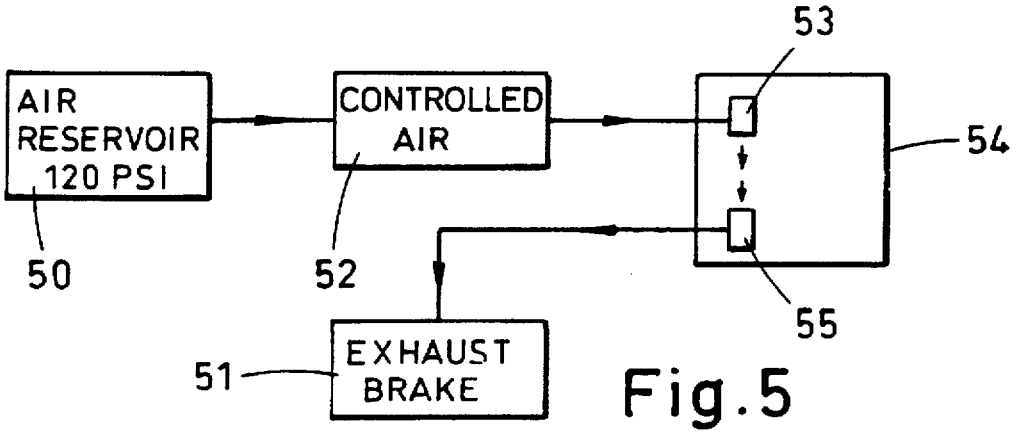
FIG. 5 is a diagrammatic representation illustrating control being effected from the driving cab of a vehicle.

FIG. 5 illustrates a diagrammatical representation of the exhaust brake system applied to a vehicle in which a pressurised air tank 50 for a vehicle which is usually at 120 lbs/sq in. (827.28 kPa) supplies pressurised air to piston 23 of an exhaust brake 51.

The air tank is connected with a controller 52 for controlling the flow of pressurised air to the exhaust brake to set the piston 26 and hence plate 29. However, the controller is itself controllable by a switch 53 located in the driver's cab of a vehicle and represented by block 54 in FIG. 5. Mechanism 55 represents the usual operating mechanism for operating the exhaust brake in the usual manner. In operation switch 53 sets the manner of operation of the exhaust brake, that is, on/off, or partially on to accord with road conditions.

Most maximum manifold pressures are in the range 60 to 65 psi. (413.64 to 448.11 kPa). These valves are the general range of maximum manifold pressures before valve damage will occur in say a 500 HP weighted engine. If the maximum exhaust manifold pressure was reduced to say 40 lbs per sq in. (275.76 kPa) the engine would be rated at 200 HP.

The general range of operating manifold pressures experienced in an engine is usually between 25 and 65 lbs/sq in. (172.35 to 448.11 kPa). It is to be noted that for a manifold pressure of 60 lbs/sq in. (413.64 kPa) it would be necessary to apply air pressure to pistons 23, 26 with a pressure of 85 lbs/sq in. (585.99 kPa) at which point the plate 29 would close the aperture 41 through the valve gate 15.

However, in accordance with the present invention the exhaust brake is constructed to be set to operate by the driver of the vehicle in his driving compartment in accordance with the conditions which prevail on the roads on which the vehicle is travelling at any particular time. Accordingly, if the roads are particularly dry and relatively safe so that the maximum exhaust brake pressure can be applied this condition can be selected. This maximum pressure refers to the maximum manifold pressure set by the engine manufacturer and in this example is 65 lbs/sq. in. In very extreme emergency conditions the exhaust brake can be operated at the vehicles maximum stored pneumatic pressure in its air reservoir, as the exhaust brake control has an emergency position which the driver is able to select upon breaking a snap pin for example.

If the roads are particularly slippery and it is possible that a jack-knife situation may occur then it is possible for the driver of the vehicle to set the exhaust brake so that it will not fully operate and therefore if used in such conditions it will only be partially applied thus protecting against the jack-knife effect.

The exhaust brake closure plate starts to generate manifold pressures when it is over half closed and less than 40 lbs/sq in. is required by the operating cylinder to fully close the exhaust brake with manifold pressure at 65 lbs/sq in. (the average maximum allowed). Less than 20 lbs/sq in. is required to hold the brake in its closed position, therefore, a very wide band of retardation is available. The significant advantage to the control of manifold pressure in this manner is that an engine which has a maximum allowable manifold pressure of 65 lbs/sq in. is capable of obtaining 100 lbs/sq in. at over speed revolutions, the 65 lbs sq/in. manifold pressure is generated with an operating cylinder pressure of 80 lbs/sq in. Therefore in an emergency situation i.e. vehicle run away, the driver is able to override the usual maximum valve setting to increase the operating cylinder pressure and obtain 100 lbs sq/in. manifold pressure plus.

It is envisaged there will be four selectable positions of the plate 29 when the gate 15 is in the closed position of the exhaust brake. The positions are (a) with the plate 29 in its fully opened position, (b) with the plate 29 in its fully closed position sealing the through passage 41 and two intermediate positions giving various degrees of application of the exhaust brake.

The operation of piston 26 described above is effected only when the piston 23 has been operated to move the valve gate 15 across the valve opening 14 to close the valve. Slight additional pressure in say steps of 15 lbs/sq in. are used to separate the pre-selectable settings of the exhaust brake venting plate 29.

If necessary only three positions can be provided as being selectable from the cab of the driver whilst the vehicle is moving these positions being (a) and (b) above and one intermediate position. More than four positions can be provided if necessary.

Conveniently, the exhaust brake assembly as shown in FIG. 2 is provided with scraper rings or washers to continually clean push rod 21 to release carbon depositions. The washers are located respectively between a gasket 50, back plate 51 and the end plate 16 of the exhaust brake assembly. The two washers between the back plate and end plate 16 are spaced by a spring which has the effect of preventing chattering of the washers and also applying pressure between the washers to ensure effective scraping of the push rod 21.

Whilst the rod 21 is described as being of a heat resisting material both the rods 21 and 27 may be of heat resisting material such as stainless steel or carbon fibre.

The piston/cylinder assembly 17 is also provided with a breather aperture 56 to allow release of air trapped in the cylinder between the piston 23 and end plate 16.

Figure 3:
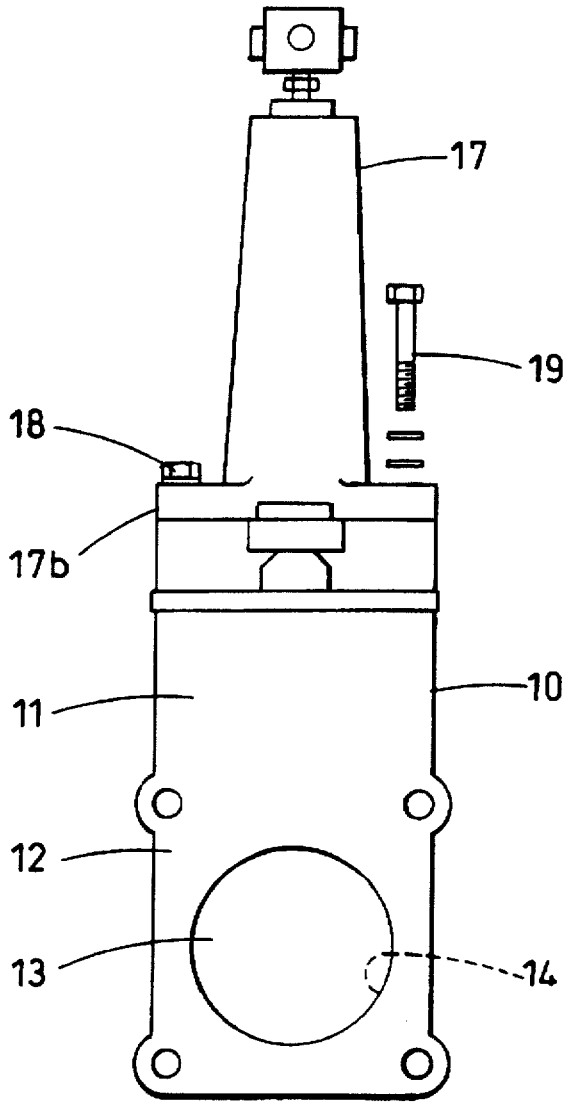
FIG. 3 is a front elevational view of a substantially assembled exhaust brake.

The passageway 17*a* and 23*a* although passing centrally through cylinder device 17 and piston 23 can be offset and a coupling may be connected to the cylinder 17 as shown in FIG. 3. Other forms or shapes of pistons can be used.

Although FIG. 5 describes one method of controlling the air pressure to the exhaust brake other methods can be used such as applying the air reservoir directly to the control valve in the vehicle driving compartment.

In the embodiment described herein the second seal housing is attached to the shaft rod but these members may be simply abutted one against the other. Any gap appearing between the second seal housing and shaft rod during operation of the exhaust brake is of no consequence.

I claim:

1. An exhaust brake of the sliding valve gate (15) type comprising a piston cylinder device (17) for operating the slidable valve gate (15) to close the exhaust brake, an aperture (54) through the valve gate for relieving manifold pressure, and control means (6, 26, 28, 29) for controlling the exhaust gases through the aperture in the valve gate, characterised in operable means 20, 23, 25, 26, 30 being operable by the same pressure source as that for operating the control means (29) to control venting of exhaust gases in addition to the control available by said control means.

2. An exhaust brake as claimed in claim 1, characterised in adjustable means (53) locatable in the driving compartment of a vehicle for controlling the pressure level of fluid applied to the exhaust brake.

3. An exhaust brake as claimed in claim 2, characterised in that the adjustable means (53) is additional to mechanism for operating an exhaust brake valve.

4. An exhaust brake as claimed in claim 1, characterised in a first seal housing (20, 23) located in the piston cylinder (17) of the exhaust brake, the first seal housing (23) having a second seal housing (26) mounted thereon being operable from the same fluid pressure source as the first seal housing.

5. An exhaust brake as claimed in claim 4, characterised in that the second seal housing (26) is located within a cylinder (25) attached to the first seal housing (23).

6. An exhaust brake as claimed in claim 5, characterised in that the second seal housing (27) is attached to the side of the first seal housing (23) remote from the pressure fluid input thereto.

7. An exhaust brake as claimed in claim 6, characterised in that the first seal housing (23) has passage means (23*a*) therein for allowing pressurised fluid to be applied to the second seal housing (26).

8. An exhaust brake as claimed in claim 1 characterised in that the second seal housing (26) is attached to a shaft rod (27) at one end thereof, the opposite end of the shaft rod being connected to a valve plate (29) of the exhaust brake for controlling the exhaust or vent in the aperture (54) through the slidable valve gate (15) of the exhaust brake.

9. An exhaust brake as claimed in claim 8, characterised in that the second seal housing (26) is abutted against the shaft rod (27).

10. An exhaust brake as claimed in claim 8, characterised in that the second seal housing (26) is permanently attached to the shaft rod (27).

11. An exhaust brake as claimed claim 1, characterised in that a free end of a hollow push rod (21) is placed from the second seal housing cylinder in the open condition of the exhaust brake to assist main spring (24) to withdraw the slidable valve gate (15) for high manifold pressure engines.

12. An exhaust brake as claimed in claim 1, characterised in pressure means (17*a*) for applying operating air pressure to a first piston to control the exhaust gas venting aperture (54), and to apply increased operating air pressure through a second piston (26) once the operating air pressure acting upon main piston (23, 23*b*) has moved the sliding gate (15) to the closed position.

13. An exhaust brake as claimed in claim 12, characterised in that the adjustable pressure level is arranged to be above the pressure usually required to close the exhaust valve.

14. An exhaust brake as claimed in claim 1, characterised in that the change in pressure is in steps of 15 lbs per square inch (103.42kPa) and is variable up to a maximum air pressure stored by the vehicle air pressure reservoir.

* * * * *

UNITED STATES PATENT AND TRADEMARK OFFICE

CERTIFICATE OF CORRECTION

PATENT NO. : 5,630,392

DATED : May 20, 1997

INVENTOR(S) : Victor A. Harris

It is certified that error appears in the above-indentified patent and that said Letters Patent is hereby corrected as shown below:

On title page, item 30, "061693" should be -- 9312389.1 --.

Signed and Sealed this

Second Day of September, 1997

*Attest:*

BRUCE LEHMAN

*Attesting Officer*

*Commissioner of Patents and Trademarks*